United States Patent [19]

Nakatomi et al.

[11] Patent Number: 4,806,970

[45] Date of Patent: Feb. 21, 1989

[54] RECORDING APPARATUS HAVING AN ACCESSIBLE HOUSING

[75] Inventors: Yoshitsuga Nakatomi, Yokosuka; Goro Oda, Sagamihara; Hidetoshi Aoki, Yokohama, all of Japan

[73] Assignee: Kabushiki Kaisha Toshiba, Kawasaki, Japan

[21] Appl. No.: 130,544

[22] Filed: Dec. 9, 1987

[30] Foreign Application Priority Data

Dec. 10, 1986 [JP] Japan ..... 61-292493

[51] Int. Cl.[4] ..... G03G 15/20

[52] U.S. Cl. ..... 355/3 FU; 355/14 FU; 219/216

[58] Field of Search ..... 355/3 R, 3 FU, 14 FU; 219/216

[56] References Cited

U.S. PATENT DOCUMENTS

| | | | |
|---|---|---|---|
| 3,913,521 | 10/1975 | Bar-on | 219/216 X |
| 4,384,781 | 5/1983 | Takada | 355/3 FU |
| 4,598,990 | 7/1986 | Kusumoto et al. | 355/3 FU |
| 4,657,372 | 4/1987 | Ikeda et al. | 355/3 R |

FOREIGN PATENT DOCUMENTS

| | | | |
|---|---|---|---|
| 56-91268A | 7/1981 | Japan | 355/3 FU |
| 56-107279 | 8/1981 | Japan | 355/3 FU |
| 56-137376 | 10/1981 | Japan | 355/3 FU |
| 61-18984 | 1/1986 | Japan | 355/3 FU |

OTHER PUBLICATIONS

Brown, L. C., Fitts, U. J., "Hot Roll Fuser Safety Interlock", IBM Tech. Discl. Bul., vol. 20, No. 1, Jun. 1977, pp. 29–30.

*Primary Examiner*—A. C. Prescott
*Assistant Examiner*—Jane Lau
*Attorney, Agent, or Firm*—Foley & Lardner, Schwartz, Jeffery, Schwaab, Mack, Blumenthal & Evans

[57] ABSTRACT

A recording apparatus comprises a housing having an opening in an upper surface thereof, and an image-fixing device in the form of a unit which fixes a toner image on paper. The housing has a mounting section at a position facing the opening, for detachably mounting thereon the image-fixing unit. The housing also includes a door for covering and exposing the opening. The door need only be opened in order for the image-fixing unit to be removed from the housing.

3 Claims, 6 Drawing Sheets

RECORDING APPARATUS HAVING AN ACCESSIBLE HOUSING

BACKGROUND OF THE INVENTION

The present invention relates to a recording apparatus and, more particularly, to a laser printer.

FIG. 1 shows a conventional laser printer. Reference numeral 2 denotes a housing. Located at the lower portion of housing 2 is cassette 4 which holds sheets of paper P. Paper P is extracted from cassette 4 by paper-supply roller 6, and is conveyed via guide 8 to a pair of register rollers 10 where it is positioned in preparation for image formation. Paper P is then fed between photosensitive drum 12 and transfer charger 14. Photosensitive drum 12 carries thereon a toner image formed by exposure means 16, developing means 18, etc. The toner image is transferred to paper P by transfer charger 14. After the transfer of the toner image, paper P is conveyed via guide 20 to image-fixing means 22, which includes heat roller 24 and press roller 26. Image-fixing means 22 fixes the toner image on paper P. Thereafter, paper P is conveyed by a pair of exit rollers 28 to an external tray, not shown.

Housing 2 comprises upper unit 30 and lower unit 32. Upper unit 30 is pivotally movable about shaft 34, whereby housing 2 can be opened and closed as required.

Image-fixing means 22 includes cover 36 surrounding heat roller 24 and press roller 26. Cover 36 is secured to lower unit 32.

Press roller 26 can be brought into contact with or set apart from heat roller 24 by the operation of arm 38. More specifically, as upper unit 30 is opened, arm 38, which is urged by spring 40, turns clockwise. Hence press roller 26 moves away from heat roller 24. As upper unit 30 is closed, arm 38 is pushed downward by cover 42 of exit roller 28. As a result, arm 38 turns counterclockwise, and press roller 26 is pressed against heat roller 24.

In the conventional apparatus, cover 36 of image-fixing means 22 is secured to lower unit 32 of housing 2, as described above. With this structure, in order to replace heat roller 24 or press roller 26 with a new one, numerous parts arranged near roller 24 or 26 must be detached from the housing, making the replacement very troublesome, time consuming and expensive.

SUMMARY OF THE INVENTION

The object of the invention is to provide a recording apparatus whose image-fixing means can be easily detached from the housing, thus facilitating easy replacement of the same.

According to an aspect of the present invention, there is provided a recording apparatus which comprises: a housing having an opening in an upper surface thereof; image-fixing means in the form of a unit for fixing an image on an image recording medium; mounting means arranged at a position facing the opening of the housing, for detachably mounting thereon the image-fixing means; and door means for exposing and covering the opening.

According to the present invention, the door means need simply be opened in order to remove the image-fixing means from the housing, through the opening.

DETAILED DESCRIPTION OF THE PREFERRED EMBODIMENT

An embodiment of the invention will now be described, with reference to the accompanying drawings.

Figure 1:
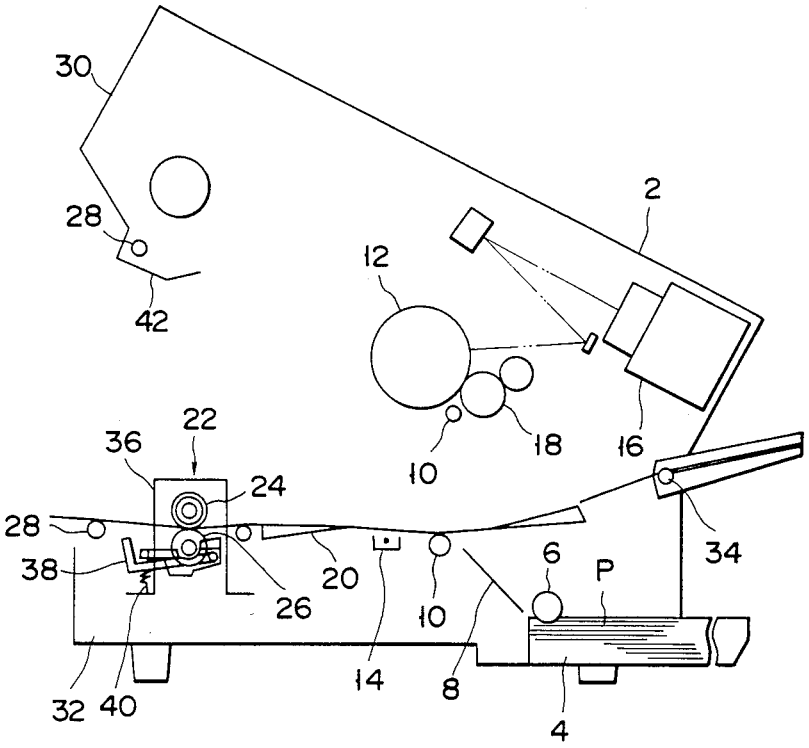
FIG. 1 is a view schematically showing a section of a conventional laser printer.
Figure 2:
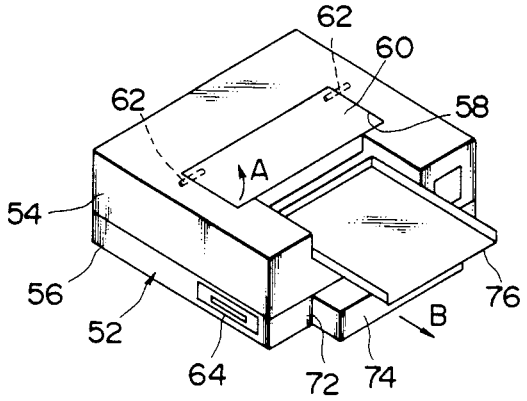
FIG. 2 is a perspective view of a laser printer as a recording apparatus, according to the invention.
Figure 3:
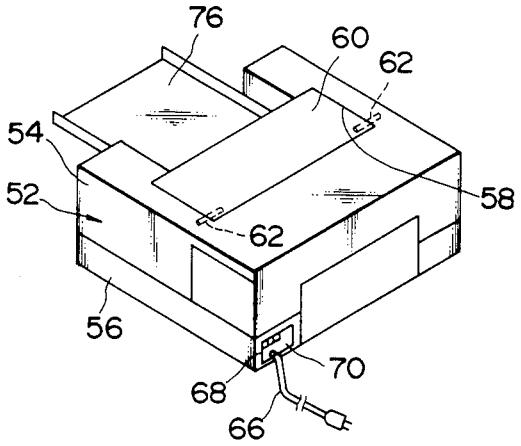
FIG. 3 is another perspective view of the laser printer of FIG. 2, showing a different aspect thereof from that shown in FIG. 2.

FIGS. 2 and 3 show the exterior of a laser printer as a recording apparatus according to the invention. In the figures, reference numeral 52 denotes a housing which comprises upper unit 54 and lower unit 56. Upper unit 54 is pivotally movable relative to lower unit 56.

Upper unit 54 has opening 58 formed in an upper 10 surface thereof. Door 60 is arranged at opening 58, for covering and exposing the same. Door 60 is pivotable about a pair of shafts 62, so that it can be opened in the direction indicated by arrow A in FIG. 2.

Interface connector 64 is located on one side of lower unit 56, for supplying signals to and receiving them from an external computer. Power switch 68 and earthing terminal 70 are located on the back side of lower unit 56. Power-supply cord 66 is also connected to the back side of lower unit 56.

Lower unit 56 has a cassette-mounting section 72 at a bottom portion thereof. Mounted on cassette-mounting section 72 is paper-supply cassette 74, which can be detached therefrom as indicated by arrow B in FIG. 2. Tray 76 is arranged above cassette-mounting section 72.

Figure 4:
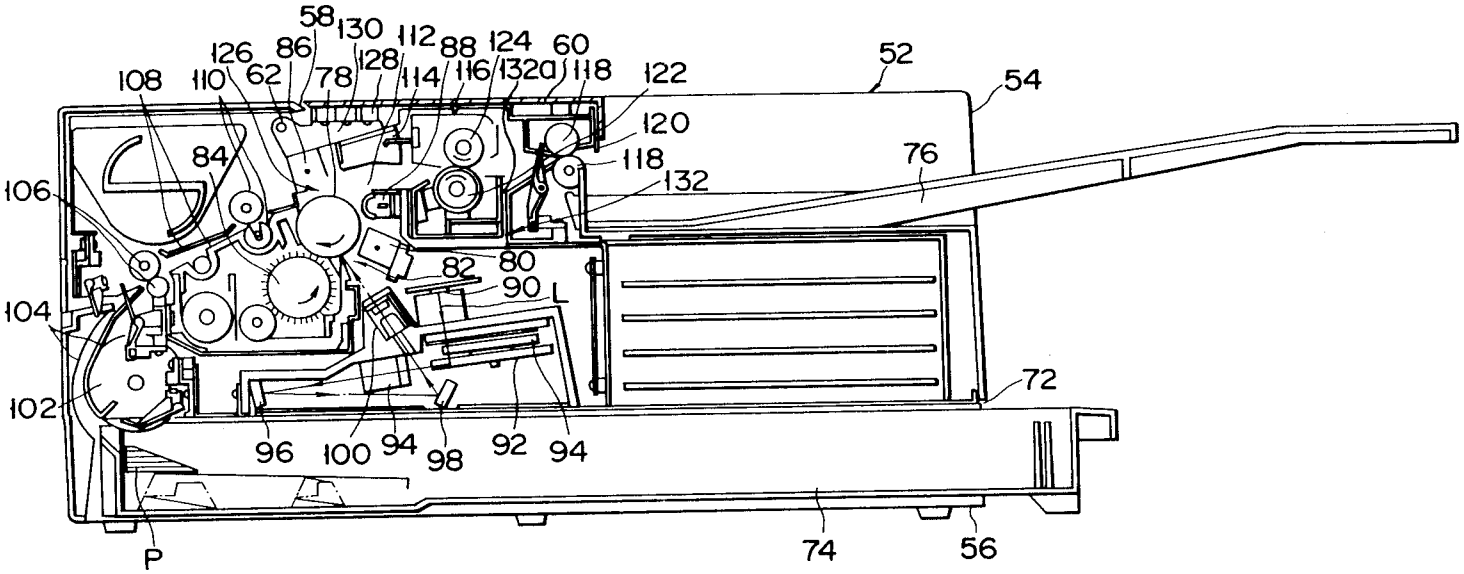
FIG. 4 is a schematic sectional view of the printer shown in FIG. 2.

As is shown in FIG. 4, photosensitive drum 78 is arranged within housing 52 and is rotatable in the direction indicated by the arrow. Electrostatic charger 80, exposure section 82, developing means 84, transfer charger 86, and discharger means 88 are arranged, in the order mentioned, around photosensitive drum 78, in the direction of rotation of drum 78.

Reference numeral 90 denotes a laser beam generator for generating laser beam L which has been modulated by image signals supplied from an external device such as a personal computer and word processor. Laser beam L is applied to polygon mirror 92, which is rotated by drive motor 94. Laser beam L is deflected by polygon mirror 92, to be applied via lens 94, second mirror 96, third mirror 98, and lens 100 to photosensitive drum 78.

Sheets of paper P contained in cassette 74 are extracted, one by one, by paper-supply roller 102, and are fed, via a pair of guides 104, to a pair of aligning rollers 106, which positions paper P in preparation for image formation. Paper P is then conveyed via a pair of guides 108 and a pair of rollers 110 to paper transport path 112, which is located above photosensitive drum 78. Transfer charger 86, guide 114, image-fixing means 116, a pair of exit rollers 118, and discharger brush 120 are arranged, in the order mentioned, along paper transport path 112, in the direction of travel of paper P. Image-fixing means 116 includes heat roller 122 and press roller 124. Tray 76 is arranged at the discharge side of exit rollers 118.

To perform an image forming operation, the surface of photosensitive drum 78 is, first of all, uniformly charged by electrostatic charger 80. Then, the surface of photosensitive drum 78 is scanned with laser beam L which has been deflected by polygon mirror 92, whereby an electrostatic latent image is formed on the surface of drum 78. Developing means 84 supplies toner (i.e., developing agent) to drum 78, so as to render visible the electrostatic latent image. In this manner, a toner image is formed on the surface of photosensitive drum 78.

Paper-supply roller 102 extracts paper sheets P, one by, from of cassette 74. Paper P is then conveyed via guide 104 to register roller 106, where it is positioned in preparation for image formation. Then, paper P is fed via guide 108 and roller 110 to image-transfer section 126, arranged between photosensitive drum 78 and transfer charger 86. In image-transfer section 126, the toner image formed on drum 78 is transferred onto paper P by the action of transfer charger 86. Thereafter, paper P is conveyed to image-fixing means 116, while being guided by guide 114. Image-fixing means 116 fixes the toner image on paper P, which is then discharged from exit rollers 118 to tray 76.

Door 60 is attached to upper unit 54 of the housing and faces paper transport path 112 located above photosensitive drum 78. Bracket 130 is attached to the inner surface of door 60 by means of fixing means 128. Transfer charger 86, guide 114, one of exit rollers 118, and discharger brush 120 are attached to bracket 130. Bracket 130 is pivotally movable, together with door 60, about shafts 62.

Figure 5:
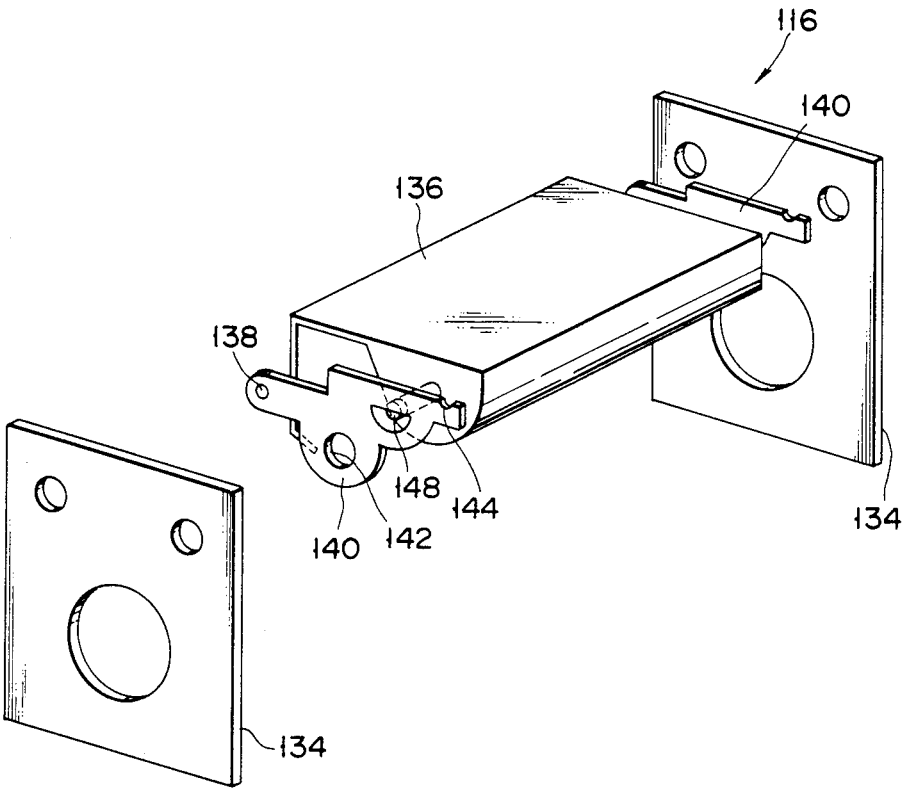
FIG. 5 is a perspective, exploded view of an image-fixing unit with a heat roller and press roller removed, used in the printer of FIG. 2.
Figure 6:
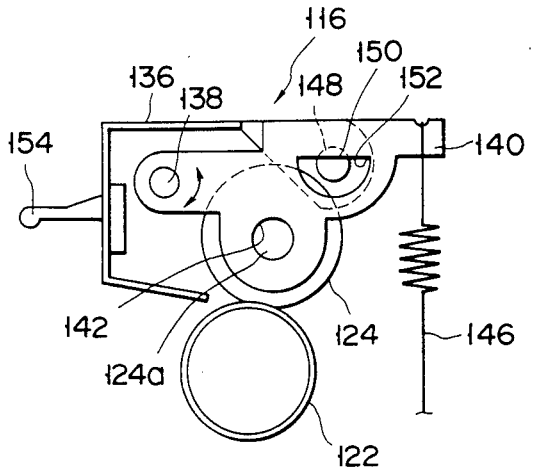
FIG. 6 is a side view of the image-fixing unit of FIG. 5, with a frame removed.
Figure 7:
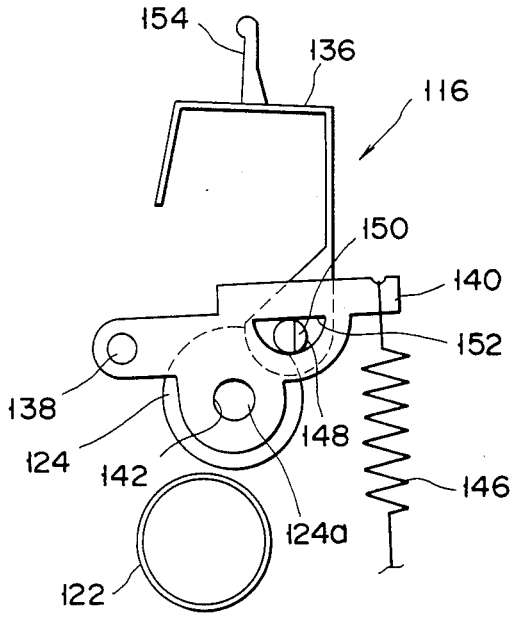
FIG. 7 is a view showing the image-fixing unit of FIG. 6 wherein the press roller is set apart from the heat roller.

Image-fixing means 116 is in the form of a unit and is removably positioned in mounting section 132, which is located in an upper portion of housing 54. Mounting section 132 includes a frame **132*a* which surrounds the lower part of image-fixing means 11*b*. As is shown in FIGS. 5 to 7, image-fixing unit 116 has a pair of frames 134 between which is arranged upper frame 136. Arranged at a lower portion of frames 134 is heat roller 122, which is rotatably supported by a bearing (not shown). Arms 140 are each rotatably supported at one end thereof by shaft 138, located in an upper portion of frame 134. Each arm 140 has opening 142 formed in a central portion thereof, by means of which shaft 124*a* of press roller 124 is rotatably held in place. Cutaway portion 144 is formed at the tip of arm 140. One end of tension spring 146 is engaged by cutaway portion 144, and its other end fixed to frame 134. Press roller 124 is pressed against heat roller 122 by the force exerted by tension springs 146**.

Shaft 148 projects from each of the opposite outer side surfaces of upper cover 136. Part of the outer end of each shaft 148 is cut away, thereby forming stepped portion 150. Semi-circular engaging hole 152 is formed in each of arms 140, such that it engages with stepped portion 150 of shaft 148.

Figure 8:
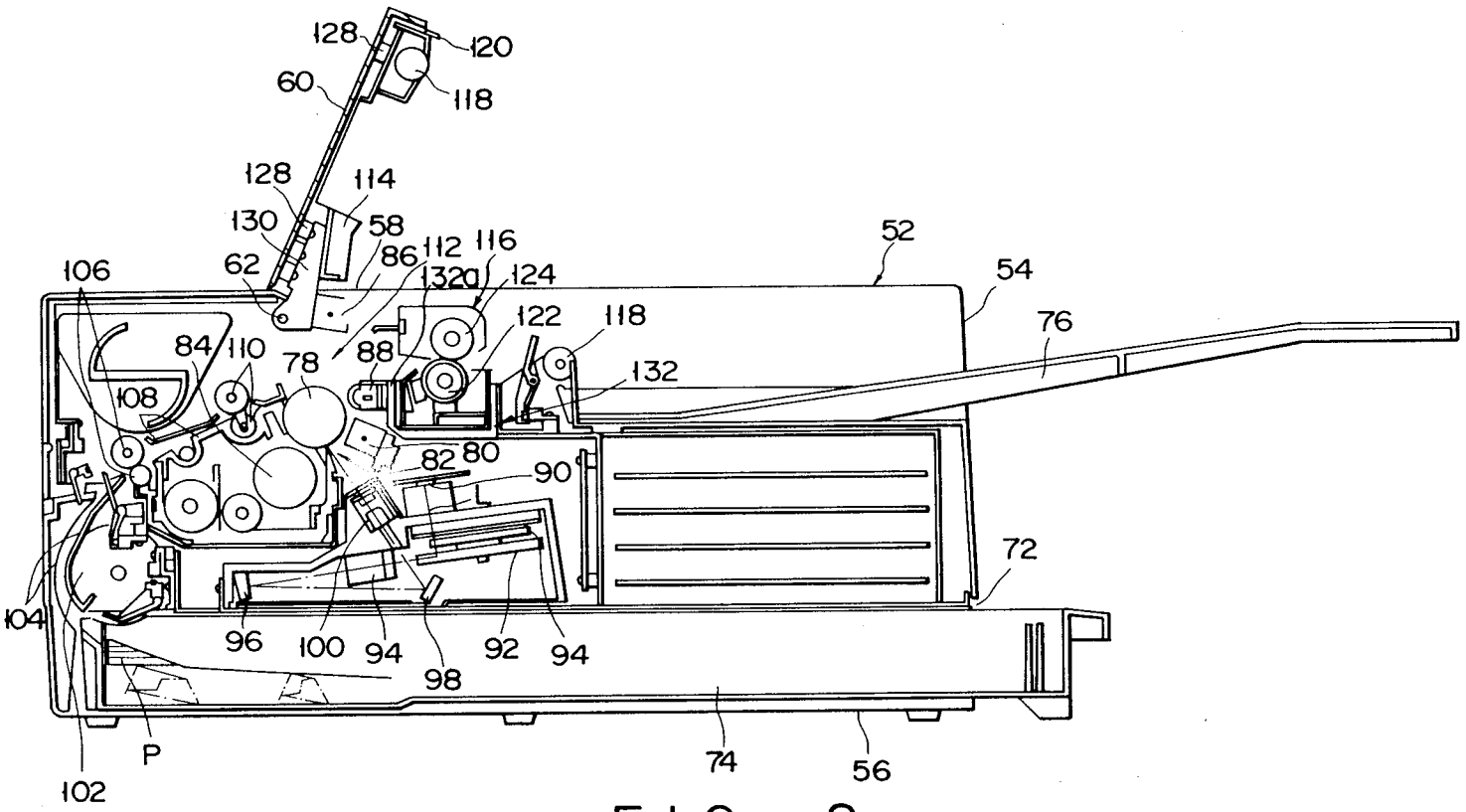
FIG. 8 is a sectional view of the printer of FIG. 4 with a door opened.

The replacing of image-fixing unit 116 is carried out in the following manner:

First, as is shown in FIG. 8, door 60 of housing 52 is rotated upward about shafts 62, thereby exposing opening 58. Next, handle 154 of upper cover 16 is turned upward and pulled up, whereby image-fixing unit 116 is detached from mounting section 132 of housing 52. The image-fixing unit 116 can now be taken out through opening 58, after which a new image-fixing unit 116 can be mounted on mounting section 132, and door 60 again closed.

When paper P is jammed in image-fixing unit 116, door 60 is opened, and upper cover 136 of image-fixing unit 116 is turned upward by 90 degrees. Hence, stepped portion 150 of shaft 148 attached to upper cover 136 moves from the horizontal position shown in FIG. 6 to the vertical position shown in FIG. 7. As a result, arm 140 turns slightly counterclockwise about shaft 138, against the force of tension spring 146. Press roller 124 therefore moves upward away from heat roller 122, whereby paper P jammed between heat roller 122 and press roller 124 can be removed.

Since image-fixing means 116, which is in the form of a unit, is detachably set in mounting section 132 arranged in the upper portion of housing 52, it can be easily taken out through opening 58 in the upper surface of housing 52, with door 60 opened. Unlike the conventional apparatus, it is not necessary to detach numerous parts for the replacement of image-fixing means 116.

Further, simply by opening upper cover 136 of image-fixing unit 116, press roller 124 is separated from heat roller 122, enabling jammed paper P to be removed with ease.

What is claimed is:

1. A recording apparatus comprising:

a housing having an opening in an upper surface thereof;

image-fixing means in the form of a unit, for fixing an image on an image recording medium;

mounting means arranged at a position facing the opening of the housing, for detachably mounting thereon said image-fixing means; and door means for selectively exposing or closing said opening;

wherein said image-fixing means includes a pair of image-fixing rollers in contact with each other, a cover means movable between a first position, where it covers the upper portions of the pair image-fixing rollers, and a second position, where it exposes said upper region, and an interlocking means for bringing the image-fixing rollers into tight contact with each other when the cover means is in the first position and separating the image-fixing rollers from each other when the cover means is in the second position.

2. An apparatus according to claim 1, wherein said cover means is rotatable between a horizontal position, where it covers the upper region of the image-fixing rollers, and a vertical position, where it exposes said upper region, and said interlocking means brings the image-fixing rollers into tight contact with each other when the cover means is in the horizontal position, and separates the image-fixing rollers from each other when the cover means is in the vertical position.

3. An apparatus according to claim 2, wherein said image-fixing means includes a handle which is attached to the cover means and by means of which the image-fixing means can be pulled up.

* * * * *

UNITED STATES PATENT AND TRADEMARK OFFICE

CERTIFICATE OF CORRECTION

PATENT NO. : 4,806,970

DATED : February 21, 1989

INVENTOR(S) : Yoshitsugu NAKATOMI et al

It is certified that error appears in the above-identified patent and that said Letters Patent is hereby corrected as shown below:

In [75] Inventors:

"Yoshitsuga" should read --Yoshitsugu--.

Signed and Sealed this

Twenty-seventh Day of February, 1990

*Attest:*

JEFFREY M. SAMUELS

*Attesting Officer*

*Acting Commissioner of Patents and Trademarks*